United States Patent [19]

Stone

[11] 4,044,536

[45] Aug. 30, 1977

[54] APPARATUS AND METHOD FOR REMOVING BOBBINS ON SPINNING MACHINES

[76] Inventor: James D. Stone, 412 Rockmont Road, Greenville, S.C. 29607

[21] Appl. No.: 651,130

[22] Filed: Jan. 21, 1976

[51] Int. Cl.[2] ..... D01H 9/04

[52] U.S. Cl. ..... 57/52; 57/156

[58] Field of Search ..... 57/52–54, 57/156

[56] References Cited

U.S. PATENT DOCUMENTS

| | | | |
|---|---|---|---|
| 3,054,249 | 9/1962 | Bahnson, Jr. | 57/52 |
| 3,398,519 | 8/1968 | Haussman | 57/53 X |
| 3,686,847 | 8/1972 | Vignon | 57/52 |

*Primary Examiner*—Richard C. Queisser
*Assistant Examiner*—Charles Gorenstein
*Attorney, Agent, or Firm*—Bailey, Dority & Flint

[57] ABSTRACT

This invention relates to the automatic removal or doffing of bobbins from top-loading spindles on a spinning machines wherein self-aligning loop projections carried on top of the bobbins are automatically brought into alignment with bobbin engagement means for removing the bobbins from the spindles.

10 Claims, 5 Drawing Figures

APPARATUS AND METHOD FOR REMOVING BOBBINS ON SPINNING MACHINES

BACKGROUND OF THE INVENTION

Textile spinning machines are provided with a large number of bobbin spindle which are mounted on a spindle rail which usually extends along opposing sides of the spinning frame machine and may comprise as many as 200 individual spindles. Associated with each spindle is a bobbin which is received over the spindle. Yarn or other textile fibers are wound on the bobbin which, when full, is then removed from the spindle to be replaced by an empty bobbin.

Doffing is the art of removing the yarn filled bobbins from the spindle and replacing them with an empty bobbin. This is often done manually by a skilled laborer with his hands. Prior devices have been developed for removing a plurality of yarn filled bobbins simultaneously from the spinning rail such as shown in U.S. Pat. No. 3,462,934 wherein an elongated inflatable bag member is inserted into the interior of a top end of the bobbin. The bag member is then inflated to grip the bobbin for removal from the spindle. However, such a device requires a source of pressure for inflating the elastomeric bag member and the conveying of fluid pressure from the source to the bag which can result in a rather complex and costly system.

Another prior device for automatically doffing and transporting full bobbins from spindels is disclosed in U.S. Pat. No. 3,132,463 wherein a plurality of bobbin grippers are provided for gripping around a recessed portion formed in the top of the bobbin. The bobbin gripping means are carried on an endless chain running over the spindles of the spinning frame carried by a vertically and horizontally movable frame.

U.S. Pat. No. 3,686,847 discloses a later developed device which also utilizes an endless belt having a plurality of bobbin gripping devices for automatically removing and replacing bobbins in a spindle type spinning machine.

The alignment of the bobbin gripping device with the bobbin itself is a problem to which considerable attention must be given in the prior known devices. Once a yarn filled bobbin is missed by the automatic engaging device, the automatic doffing appartus must be stopped and the missed bobbin must be removed manually. This results in loss of operating time. The automatic doffing or removal of the yarn filled bobbin usually involves removing a very large number of bobbins at one time. To avoid missing a bobbin requires aligning of the bobbin gripping device with the bobbin in a highly accurate and reliable manner.

SUMMARY OF THE INVENTION

It has been found that a bobbin removal apparatus can be provided wherein a plurality of bobbins arranged over spindles on a spinning frame machine are to be automatically engaged for removal therefrom comprising a movable bobbin engagement means engaging said bobbins for removal from said spindles. A support assembly is carried adjacent the spinning frame for movably carrying the bobbin engagement means in a vertical and horizontal direction. A complimentary bobin adapter member is carried adjacent a top portion of each bobbin having a loop projection swivelably carried thereby. The loop projection has a central eye portion defined by the interior surface of the loop for receiving the engagement means therethrough. The engagement means and the loop projection have complimentary portions so that the engagement means moving in linear alignment engages the loop projection causing the eye portion to turn and automatically align with the engagement means for receiving the engagement means therethrough. Power means are provided for moving the engagement means in the vertical and horizontal directions along the support member into alignment and engagement with the loop projection.

Accordingly, an important object of the present invention is to provide automatic bobbin removal apparatus and method wherein a bobbin adapter is provided having automatic alignment for accurate and reliable engagement.

Another important object of the present invention is to provide a loop projection on a bobbin having an eye portion which automatically aligns with a doffing finger when engaged thereby.

Another important object of the present invention is to provide a bobbin adapter member which can be easily inserted in the top end of a bobbin for converting the bobbin to use with an automatic removal apparatus wherein the bobbin adapter is self-aligning with the removal apparatus.

Yet another important object of the present invention is to provide a bobbin removal and doffing apparatus which is simple in construction and is low in cost so that it may be easily applied to any existing spinning machine.

Still another important object of the present invention is to provide a bobbin engagement finger and a bobbin loop projection wherein the engagement finger may be inserted into the eye of the loop regardles of the orientation of the bobbin on the spindle in an automatically aligning manner.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
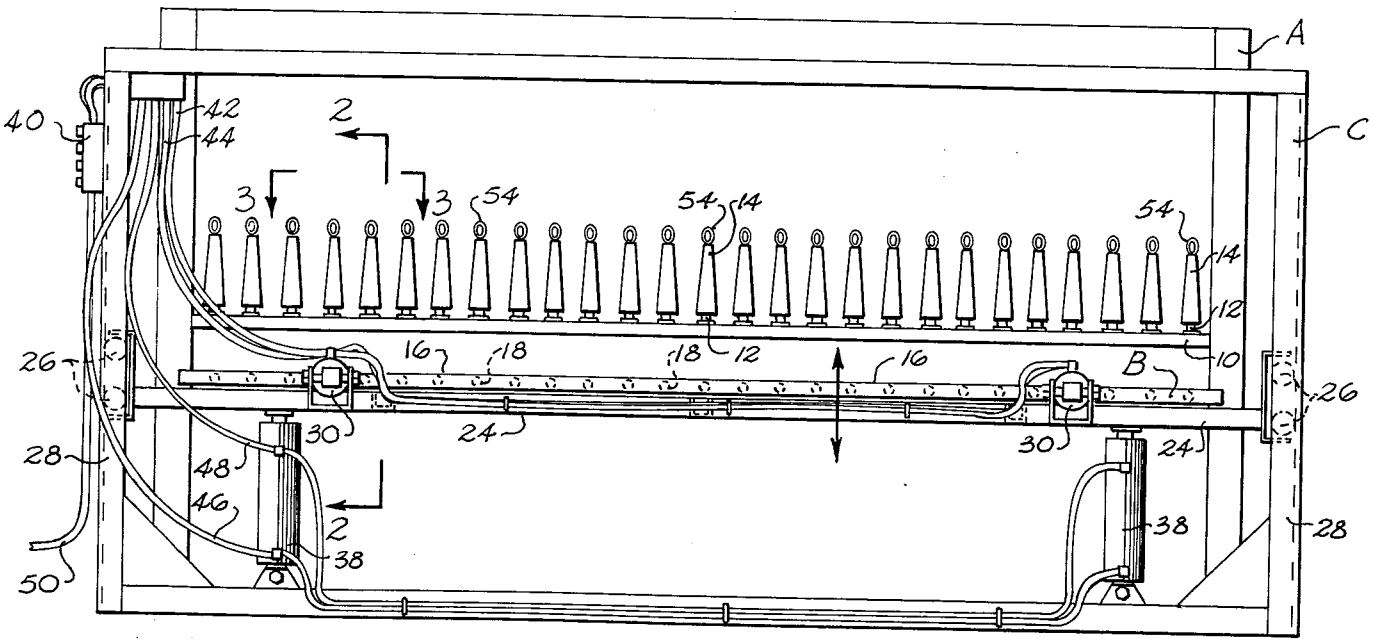
FIG. 1 is an elevational view of a spinning frame machine showing only so much of a conventional spinning frame as is necessary to illustrate the application thereto of apparatus for removing yarn filled bobbins therefrom as constructed in accordance with the present invention.
Figure 3:
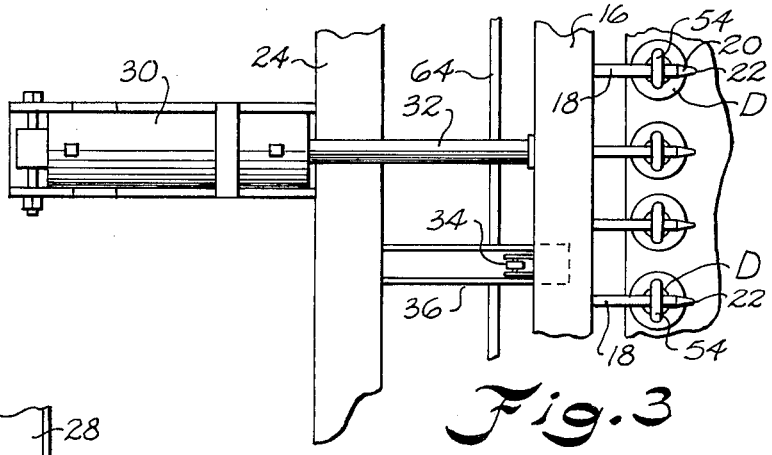
FIG. 3 is a sectional view taken along line 3—3 of FIG. 1.
Figure 2:
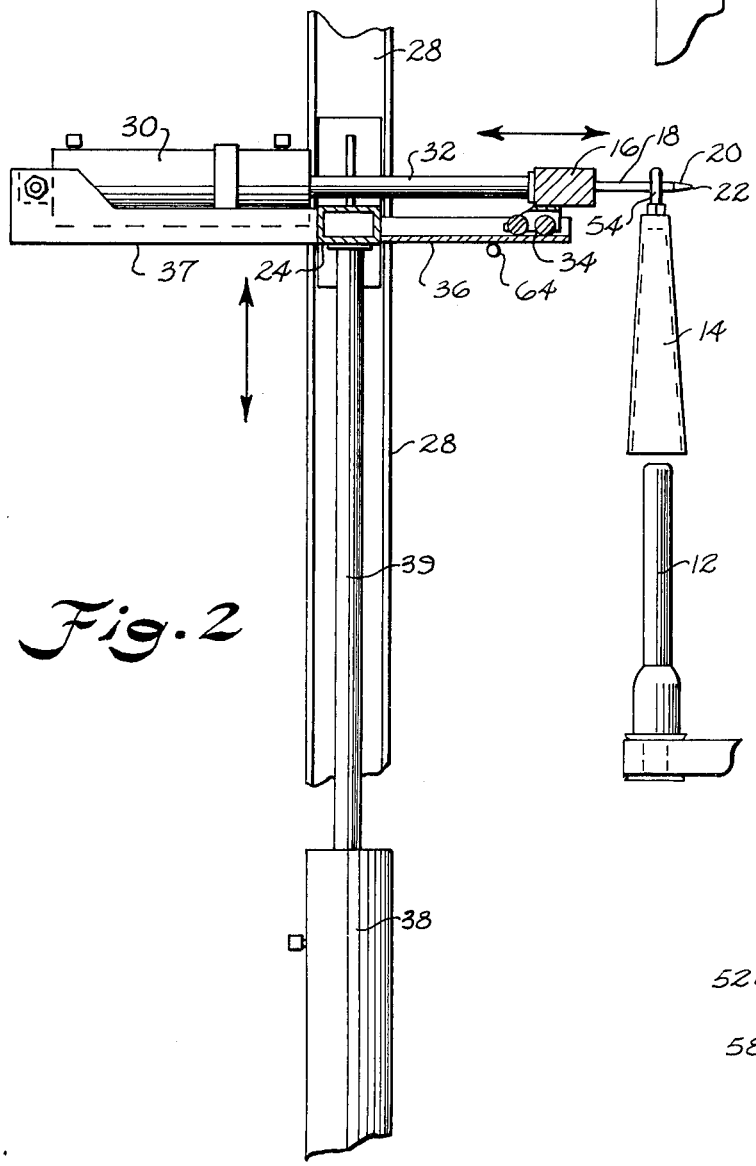
FIG. 2 is a sectional view taken along line 2—2 of FIG. 1.
Figure 4:
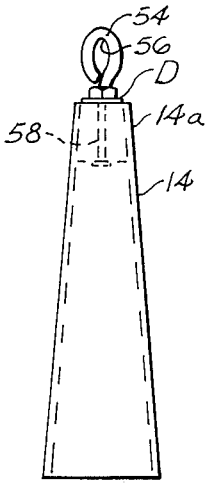
FIG. 4 is a front elevational view illustrating a bobbin with a bobbin adapter member inserted in a top portion as constructed in accordance with the present invention.
Figure 5:
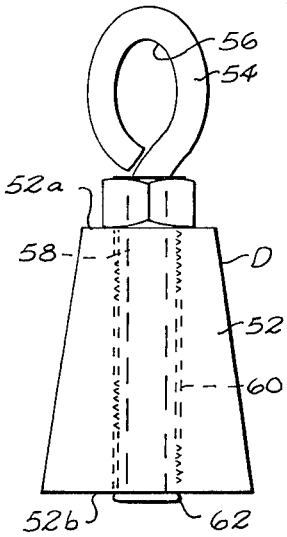
FIG. 5 is an enlarged elevational view of a bobbin adapter as constructed in accordance with the present invention for use in automatic bobbin removal apparatus.

The apparatus and method of the present invention may be utilized with any conventional spinning frame machine, and since such machines are well known in the art, it will unnecessary to disclose or describe a complete spinning machine herein. Accordingly, FIG. 1 of the drawing shows in diagramatic form only so much of a conventional ring spinning frame machine as is necessary to illustrate the application thereto of the invention.

FIG. 1 illustrates a spinning rail 10 having a plurality of spindle members 12 carried in series thereon. The spinning rail 10 is suitably supported on a frame A of the spinning machine. A plurality of bobbin members 14 are mounted on the spindle members 12 and are filled with yarn or other textile fibers in a conventional manner.

The series of spindles 12 and the bobbins 14 carried thereon as illustrated in FIG. 1 may comprise a single bank of spindles which have their associated bobbins filled at the same time. When the bobbins are filled with yarn it is desirable to engage all of the bobbins carried on the spinning rail 10 simultaneously and to remove them from the spindles.

The bobbin removal apparatus constructed in accordance with the present invention comprises a movable bobbin engagement means B for engaging and removing the bobbins 14 from the spindles 12. The bobbin engagement means B includes an elongated rail member 16 having a plurality of engaging elements 18 extending outwardly therefrom. The engaging elements 18 may be referred to more commonly as doffing fingers. The engaging elements 18 are preferably rod-shaped members having end portions 20 which are tapered substantially to a point at 22. It is important that the engaging elements 18 terminate in a point at 22 to provide complimentary means as will be more fully explained later.

The movable bobbin engagement means B is carried by a support assembly C having a vertically moving rail 24 carried by roller members 26 on vertical standards 28 of the support assembly C at remote ends. Mounted on the vertical moving rail 24 is a pair of hydraulic cylinders 30 having their associated piston rods 32 connected to and supporting the elongated rail members 16 of the bobbin engagement means B. The hydraulic cylinder 30 may be any conventional cylinder which is operated by fluid pressure such as compressed air or other suitable hydraulic fluid. Of course, it is to be understood that other arrangements may be utilized such as an electric motor and gear/rack arrangement. The elongated rail member 16 is further supported by roller members 34 on a cantilevered arm 36 carried by the vertically moving rail 24. The cylinders 30 are mounted on a rearward extension 37 of the cantilevered arm 36 using conventional bolt members. It is also to be understood that other forms or arrangements may be utilized for movably supporting the bobbin engagement means B such as traveling belt or chain arrangements.

As the hydraulic cylinder 30 is operated, the piston rod 32 moves the elongated rail 16 horizontally over the cantilevered member 36 to move the engaging elements 18 into engagement with the bobbin members. The rail 24 is moved vertically by a second pair of conventional hydraulic cylinders 38 and associated piston rods 39. Thus, the bobbin engagement means B is carried on the support assembly C for movement in a vertical and horizontal direction.

Any suitable control means such as control box 40 may be provided for selectively controlling the hydraulic cylinders 30 and 38 to move the bobbin engagement means to the desired position. A plurality of pressure outlet conduits 42 and 44 are provided for delivering fluid pressure to the cylinders 30 and pressure conduits 46 and 48 are provided for delivering fluid pressure to the hydraulic cylinders 38 in a conventional manner. An inlet pressure communicating conduit 50 is connected at one end to a source of fluid pressure and at the other end to the control box 40.

A complimentary bobbin adapter member D is provided for use with the bobbin engagement means B. The bobbin adapter member D is carried adjacent the top of the bobbin member 14. Newly made bobbins may be manufactured with bobbin adapter member D mounted in the top portion **14*a* thereof or the bobbin adapter may be inserted into an already existing bobbin member 14. The bobbin adapter member D may be pressed, glued, or pinned in the top portion 14*a*** of the bobbin.

The bobbin adapter member D includes an adapter body portion 52 which is perferably formed from any suitable material such as plastic, wood, metal, or paper. In a preferred embodiment, the adapter body 52 is tapered outwardly from the top **52*a* to the bottom 52*b*. A loop projection 54 is swivelably carried by the adapter body portion 52. The loop 54 has a central eye portion 56 defined by the interior surface of the loop projection 54 providing an engagement portion. The loop projections extend downwardly in the form of a stem 58 through a central bore 60 formed in the adapter body portion 52. The stem portion has a flanged bottom portion 62** so that the loop projection swivels in the adapter body portion. A speakman screw, brad, rivet, or any other swivel device may be utilized using the principle of the speakman screw by making a swivel connection to the adapter body portion in any conventional manner.

The bobbin adapter member D may be made in varying dimensions for various bobbin sizes. Length, diameter, and angle of taper on the adapter body portion 52 will vary according to size of fit of the associated bobbin member. The size and shape of the loop 54 in the Speakman screw will vary such as from round to semicircular or square depending on the application.

In operation, the bobbin adapter member D is mounted within the top potin **14*a* of the bobbin with the bobbin carried on the spindle 12. The bobbin engagement means B and the support assembly C are carried adjacent the spinning rail 10 of the spinning frame A. The rail 24 of support assembly C is thus raised or lowered until the elongated rail 16 of the bobbin engagement means B is in linear alignment with the loop projections 54. With the rial 16 in this position, the apparatus is arranged such tht the point 22 of each individual engaging element or doffing finger 18 passes through and intersects the vertical axis of the stem portion 58 of the speakman screw member 54. Therefore, even when the eye portion 56 of the loop projection 54 is out of alignment with the point 22 of the engaging element 18, the point 22 will first engage or strike the outer rounded surface of the loop projection 54 turning it so that the eye portion is aligned with the engaging element 18** for receiving the engaging element therethrough.

In this manner, the tapered portion 20 of the engaging element 18 defines a complimentary portion that cooperates with the loop projection 54 to automatically align the eye portion 56 regardles of the orientation of the bobbin 14 on the spindle 12. Thus, the engagement elements 18 may be accurately inserted into the eye of the loop projection without failure. The central eye portion 56 is essentially self-aligning when contacted by the complimentary point 22 of the engaging element so that engagement in a connecting relationship is effected in an accurate and reliable manner. The tendency to miss engagement with the bobbins is reduced.

An elongated abutment bar 64 is carried by the cantilevered arm members 36 so that once the bobbins 14 are engaged and lifted from their associated spindles 12, the engagement rail member 16 is retracted along the cantilevered arms 36 causing the bobbins 14 to strike the abutment bar 64 removing the bobbins 14 from the engaging elements 18. The bobbins then descend and drop onto a conveyor belt or other suitable conveying means so that the yarn filled bobbins may be transported to another station. The spindles 12 are then replenished with empty bobbins and the spinning or yarn filling process is repeated.

Thus, it can be seen that an advantageous construction and method for automatic bobbin removal apparatus can be had in accordance with the present invention. The bobbin adapter member constructed in accordance with the present invention and mounted adjacent the top of the bobbin is essentially self-aligning so that it automatically receives the bobbin engagement member for effective engagement every time. The tendency of the bobbin removal apparatus to miss a bobbin is reduced and the machinery and accompanying apparatus which is necessary to accomplish the bobbin removal or doffing is reduced in complexity and cost. This affords an automatic bobbin removal apparatus which can be economically and conveniently utilized with any conventional spinning frame machine and which can be understood and operated by a spinning machine attendant.

While a preferred embodiment of the invention has been described using specific terms, such description is for illustrative purposes only, and it is to be understood that changes and variations may be made without departing from the spirit or scope of the following claims.

What is claimed is:

1. A bobbin removal appartus wherein bobbin members arranged over spindle members on a spinning frame are to be engaged and moved from one location to another comprising:

a movable bobbin engagement means for engaging and removing said bobbins from said spindles;

a support assembly carrying said bobbin engagement means for movement in a vertical and a horizontal direction;

a bobbin adapter member carried on an upper end of each bobbin having a loop projection swivelably carried by said adapter member;

said loop projection having a central eye portion defined by an interior surface thereof for receiving said engagement means therethrough;

power means for moving said bobbin engagment means in said vertical and horizontal directions along with said support assembly into linear alignment with said eye portion of said loop projection and for engagement therewith;

said engagement means including a complimentary means for turning said loop projection to automatically align said eye portion with said engagement means for connection with said engagement means; and said bobbin engagement means being further movable by said power means to lift and remove said bobbin from said spindle and spinning frame.

2. The apparatus as set forth in claim 1 further comprising a bobbin abutment member carried by said support assembly for abutting said removed bobbins to disengage said bobbins from said bobbin engagement means.

3. The apparatus as set forth in claim 1 wherein said complimentary means includes a complimentary portion carried by said engagement means so that engagement means initially engaging said loop projection causes said eye portion to turn and automatically align with said engagement means regardless of the orientation of said bobbin on said spindle for receiving said engagement means therethrough.

4. The apparatus as set forth in claim 1 wherein said bobbin engagement means includes elongated engagement elements having end portions tapered substantially to a point to define said complimentary means, said eye of said loop projection swiveling into alignment with said engagement element when said loop projection is engaged by said point of said tapered end portion.

5. A bobbin adapter for use in automatic bobbin removal apparatus wherein bobbin members arranged over spindles on a spinning frame are to be engaged for removal therefrom, said apparatus including a movable bobbin engagement means carried on a support assembly for movement in a vertical and horizontal direction and power means for moving said bobbin engagement means in said horizontal and vertical directions; said bobbin adapter comprising:

an adapter body portion for being carried on an upper end of said bobbin;

a connecting means rotatably carried by said adapter body portion;

said connecting means including a projection means having an engagement portion for engaging in a connecting relationship with said engagement means; and said projection means being automatically self-aligning when initially engaged by said bobbin engagement means so as to turn and align said engagement portion with said bobbin engagement means regardless of the orientation of said bobbin on said spindle;

whereby said bobbin members may be effectively engaged and removed from said spindle by said automatic removal apparatus.

6. The apparatus of claim 5 wherein said projection means includes a swiveled loop projection carried by said adapter body portion, said engagement portion including a central eye portion defined by the interior surface of said loop projection.

7. The apparatus as set forth in claim 6 wherein said bobbin engagement means includes an engaging element having an end portion tapered substantially to a point for engaging said loop projection to align said eye portion in a complimentary co-operative manner.

8. The method of removing a plurality of bobbins arranged over spindles on a spinning frame by automatically engaging said bobbins for removal therefrom comprising:

a. providing a movable bobbin engagement means having a plurality of engaging elements for engaging said bobbins;

b. providing an automatically aligning adapter member carried adjacent the top of each said bobbin having a projection means with an engagement portion for receiving said bobbin engagement means;

c. moving said engagement means into linear alignment with said adapter members;

d. providing complimentary end portions on said engaging elements to initially engage said projection means of said adapter member;

e. automatically turning an aligning said engagement portion with said engagement elements for providing a connecting relationship therebetween regardless of the orientation of said bobbin on said spindle; and f. moving said engagement means to remove said bobbins from said spindles.

9. The method of claim 8 wherein said complimentary end portions are provided by forming a tapered point on the engaging ends of said engaging elements.

10. The method of claim 8 further wherein said projection means comprises a swiveled loop projection adjacent an upper end of said adapter member, said engagement portion provided by an eye portion defined by the interior surface of said loop projection.

* * * * *